US006877186B2

(12) United States Patent
Shiao

(10) Patent No.: US 6,877,186 B2
(45) Date of Patent: Apr. 12, 2005

(54) SWINGABLE HANDLE FOR A HAND TOOL

(75) Inventor: Hsuan-Sen Shiao, No. 55, Cheng-Feng Lane, Tai-Ming Rd., Wu-Jih Hsiang, Taichung Hsien (TW)

(73) Assignee: Hsuan-Sen Shiao, Tiachung Hsien (TW)

( * ) Notice: Subject to any disclaimer, the term of this patent is extended or adjusted under 35 U.S.C. 154(b) by 84 days.

(21) Appl. No.: 10/458,055

(22) Filed: Jun. 10, 2003

(65) Prior Publication Data

US 2004/0250379 A1 Dec. 16, 2004

(51) Int. Cl.[7] ..... B25G 3/00; B25B 23/16

(52) U.S. Cl. ..... 16/111.1; 16/438; 16/900; 81/177.4; 81/177.8; 81/490

(58) Field of Search ..... 16/111.1, 430, 16/436, 438, 900; 81/177.4, 177.8, 177.7, 81/490, 489; 408/241 R

(56) References Cited

U.S. PATENT DOCUMENTS 1,144,907 A * 6/1915 Knipple ..... 81/177.9
4,825,734 A * 5/1989 Schwalbe et al. ..... 81/177.9
5,069,091 A * 12/1991 Bramsiepe et al. ..... 81/177.7
5,522,291 A * 6/1996 Liu ..... 81/490
6,032,332 A * 3/2000 Lin ..... 16/111.1
6,167,787 B1 * 1/2001 Jarvis ..... 81/177.2
6,189,420 B1 * 2/2001 Shiao ..... 81/60
6,243,902 B1 * 6/2001 Huang ..... 7/165
6,382,058 B1 * 5/2002 Owoc ..... 81/177.9
6,386,075 B1 * 5/2002 Shiao ..... 81/177.8
6,520,053 B1 * 2/2003 Liao ..... 81/177.9

FOREIGN PATENT DOCUMENTS

DE 29616736 U1 * 11/1996
EP 829330 A1 * 3/1998

* cited by examiner

*Primary Examiner*—Chuck Y. Mah
(74) *Attorney, Agent, or Firm*—Webb Ziesenheim Logsdon Orkin & Hanson, P.C.

(57) ABSTRACT

A swingable handle for a hand tool includes a rear handle body with two spaced apart walls that confine a replacement bit receiving space for receiving replacement tool bits, a front handle body having a mount end portion for connection with a tool shaft, and a coupling end portion pivoted to and turnable relative to the front end of the rear handle body between normal and torque enhancing positions, and a lid member having a front end coaxially pivoted to the front end of the rear handle body and the coupling end portion so as to be turnable between open and closed positions, and a cover portion that covers the receiving space in the closed position and that permits access to the receiving space in the open position. A retaining member is disposed to arrest the coupling end portion in one of the normal and torque enhancing positions.

9 Claims, 10 Drawing Sheets

SWINGABLE HANDLE FOR A HAND TOOL

BACKGROUND OF THE INVENTION

1. Field of the Invention

This invention relates to a swingable handle for a hand tool, more particularly to a swingable handle for delivering increased torque to rotate a tool bit of a hand tool and for storing a plurality of replacement tool bits therein.

2. Description of the Related Art

A conventional handle for a hand tool includes a front handle body which is adapted to connect with a tool bit, and a rear handle body which is pivoted to and which is turnable relative to the front handle body to form an angle with the front handle body so as to permit application of an increased torque for rotating the tool bit. A chamber with a cap is formed in a rear end of the rear handle for receiving a plurality of replacement tool bits. However, as the tool bits have to be removed from the chamber to permit selection of a suitable tool bit therefrom, use is inconvenient.

Referring to FIG. 1, a conventional handle is shown to include a handle body 1 with two accommodation chambers 101,102, two mounting members 2 which are pivoted to a rear end of the handle body 1, and which have grip holes 201 for positioning a plurality of replacement tool bits (not shown), and a tool shaft 3 for connection with a tool bit. Turning of the mounting members 2 away from the handle body 1 permits removal of a desired one of the tool bits in the grip holes 201. However, the handle 1 does not permit application of an increased torque to rotate the tool bit. Moreover, the turning angle of the mounting members 2 relative to the handle body 1 is limited so that it is difficult to remove the tool bits that are close to the pivot points of the mounting members 2.

SUMMARY OF THE INVENTION

The object of the present invention is to provide a swingable handle which can deliver an increased torque to rotate a tool bit of a hand tool, and which can facilitate selection of a desired tool bit received therein.

According to this invention, the swingable handle includes a rear handle body, a front handle body, a lid member, and a replacement bit positioning member.

The rear handle body has an outer wall which defines a replacement bit receiving space therein, and which has a first front end that defines an access to the replacement bit receiving space.

The front handle body has a mount end portion which is adapted to connect with a tool shaft having a tool bit mounted thereon, and a coupling end portion opposite to the mount end portion along a rotating axis. The coupling end portion is pivoted to and is turnable relative to the first front end of the outer wall about a pivot axis in a transverse direction transverse to the rotating axis between a normal position, where the front and rear handle bodies are in line with each other, and a torque enhancing position, where the rear handle body is inclined relative to the rotating axis.

The lid member has a second front end which is pivoted to and which is turnable relative to the first front end of the outer wall about the pivot axis between open and closed positions, and a cover portion which extends from the second front end radially relative to the pivot axis and which has an inner surface that confronts the replacement bit receiving space. As such, when the second front end is in the closed position, the cover portion covers the replacement bit receiving space. When the second front end is in the open position, the inner surface of the cover portion is exposed, thereby providing access to the replacement bit receiving space.

The replacement bit positioning member is disposed on one of the inner surface and the outer wall for positioning replacement tool bits.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
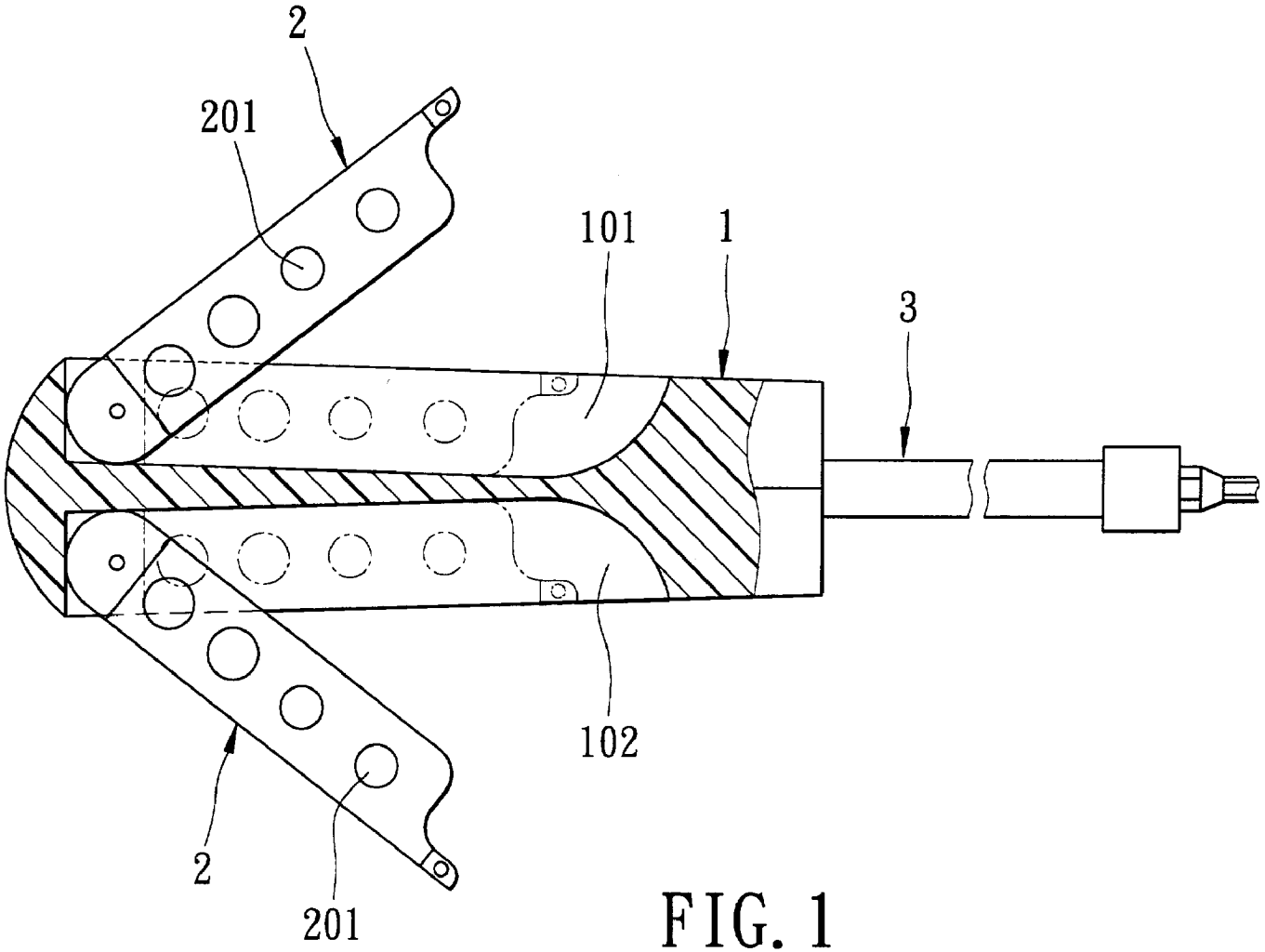
FIG. 1 PRIOR ART
FIG. 1 is a partly sectional view of a conventional handle for a hand tool.
Figure 2:
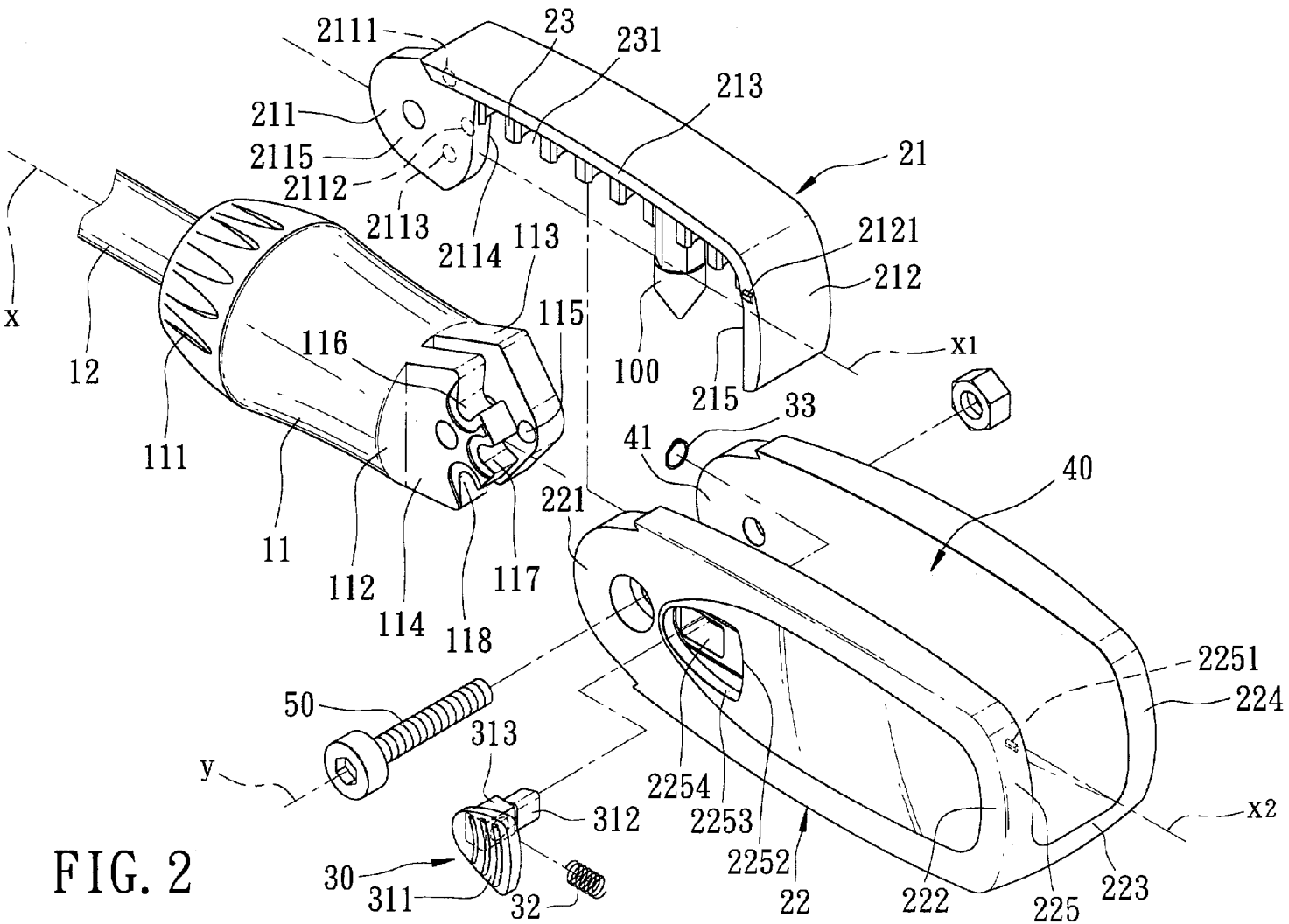
FIG. 2 is an exploded perspective view of the preferred embodiment of a swingable handle according to this invention.

Referring to FIGS. 2 to 5, the preferred embodiment of a swingable handle according to the present invention is shown to comprise a rear handle body 22, a front handle body 11, a lid member 21, a replacement bit positioning member 23, and a retaining member 30.

The rear handle body 22 is made from a transparent plastic material with an opaque sheet attached to a part thereof so that the user can see through the rear handle body 22. The rear handle body 22 has an outer wall including right and left walls 224,225 and an inner bottom wall 223. The right and left walls 224,225 are spaced apart from each other in a transverse direction. The inner bottom wall 223 extends in the transverse direction to interconnect the right and left walls 224,225 so as to confine a replacement bit receiving space 40 thereamong for receiving a plurality of tool bits 100 (only one is shown). The right and left walls 224,225 respectively have first front ends 221 which are spaced apart from each other in the transverse direction so as to confine an access 41 to the replacement bit receiving space 40, and first rear ends 222 opposite to the first front ends 221 along an axis (x2). The left wall 225 has an opening 2252 which includes a larger-dimension portion 2253 and a smaller-dimension portion 2254 to communicate with the access 41. In addition, a recess 2251 is formed on an inner surface of the first rear end 222 of the left wall 225.

The front handle body 11 has a mount end portion 111 which is adapted to connect with a tool shaft 12 that extends along a rotating axis (x) transverse to the transverse direction that is coupled with a tool bit (not shown) for rotating the latter, and a coupling end portion 112 opposite to the mount end portion 111 along the rotating axis (x). The coupling end portion 112 includes right and left coupling walls 113,114 which are spaced apart from each other in the transverse direction, and which are received in the access 41 to respectively confront the first front ends 221 of the right and left walls 224,225 in the transverse direction. The right and left coupling walls 113,114 are pivoted to and are turnable relative to the first front ends 221 about a pivot pin 50 that defines a pivot axis (y) in the transverse direction between a normal position, where the front and rear handle bodies 11,22 are in line with each other such that the axis (x2) coincides with the rotating axis (x), and a torque enhancing position, where the rear handle body 22 is inclined relative to the rotating axis (x). The left coupling wall 114 has a retaining wall surface which faces rearwards and which includes three retaining recesses 116,117,118 that are formed therein and that are angularly displaced from one another about the pivot axis (y) by 60°. A slidably retaining member includes a spring-loaded ball 115 which is retractably disposed in the right coupling wall 113.

The lid member 21 has a second front end 211 of a plate-shape which is interposed between the right and left coupling walls 113,114, and which has right and left side surfaces 2114,2115 that respectively confront the right and left coupling walls 113,114 in the transverse direction such that the first front ends 221, the right and left coupling walls 113,114 and the second front end 211 are pivoted coaxially about the pivot axis (y). Thus, the second front end 211 is turnable relative to the first front ends 221 about the pivot axis (y) between open and closed positions. The slidably retaining member further includes three recesses 2111,2112, 2113 which are formed in the right side surface 2114 of the second front end 211, and which are angularly displaced from one another about the pivot axis (y) by 60° such that the spring-loaded ball 115 is pressable to slip into a selected one of the recesses 2111,2112,2113 so as to slidably retain the second front end 211 in a corresponding one of the open position and the closed position.

The lid member 21 further has a cover portion 213 which extends from the second front end 211 along an axis (x1) and radially of the pivot axis (y) and which has an inner surface 215 that confronts the replacement bit receiving space 40. A protrusion 2121 is formed on a rear end 212 of the cover portion 213.

Referring to FIGS. 3 to 6, when the second front end 211 is in the closed position, the cover portion 213 covers the replacement bit receiving space 40 and the rear end 212 of the cover portion 213 covers the rear ends 222 of the right and left walls 224,225 of the rear handle body 22 so that the axis (x1) coincides with the axis (x2). In this state, the protrusion 2121 is press-fitted into the recess 2251 to secure the engagement between the lid member 21 and the rear handle body 22.

The replacement bit positioning member 23 is disposed on the inner surface 215, and includes a plurality of grip units 231 in form of grooves which are integrally formed with the inner surface 215 and which are disposed in tandem along the axis (x1) [i.e. in a radial direction relative to the pivot axis (y)] for positioning the replacement tool bits 100. The replacement tool bits 100 are received in the replacement bit receiving space 40 when the second front end 211 is in the closed position. Alternatively, the replacement bit positioning member 23 may be also disposed on the inner bottom wall 223 of the rear handle body 22.

Figure 9:
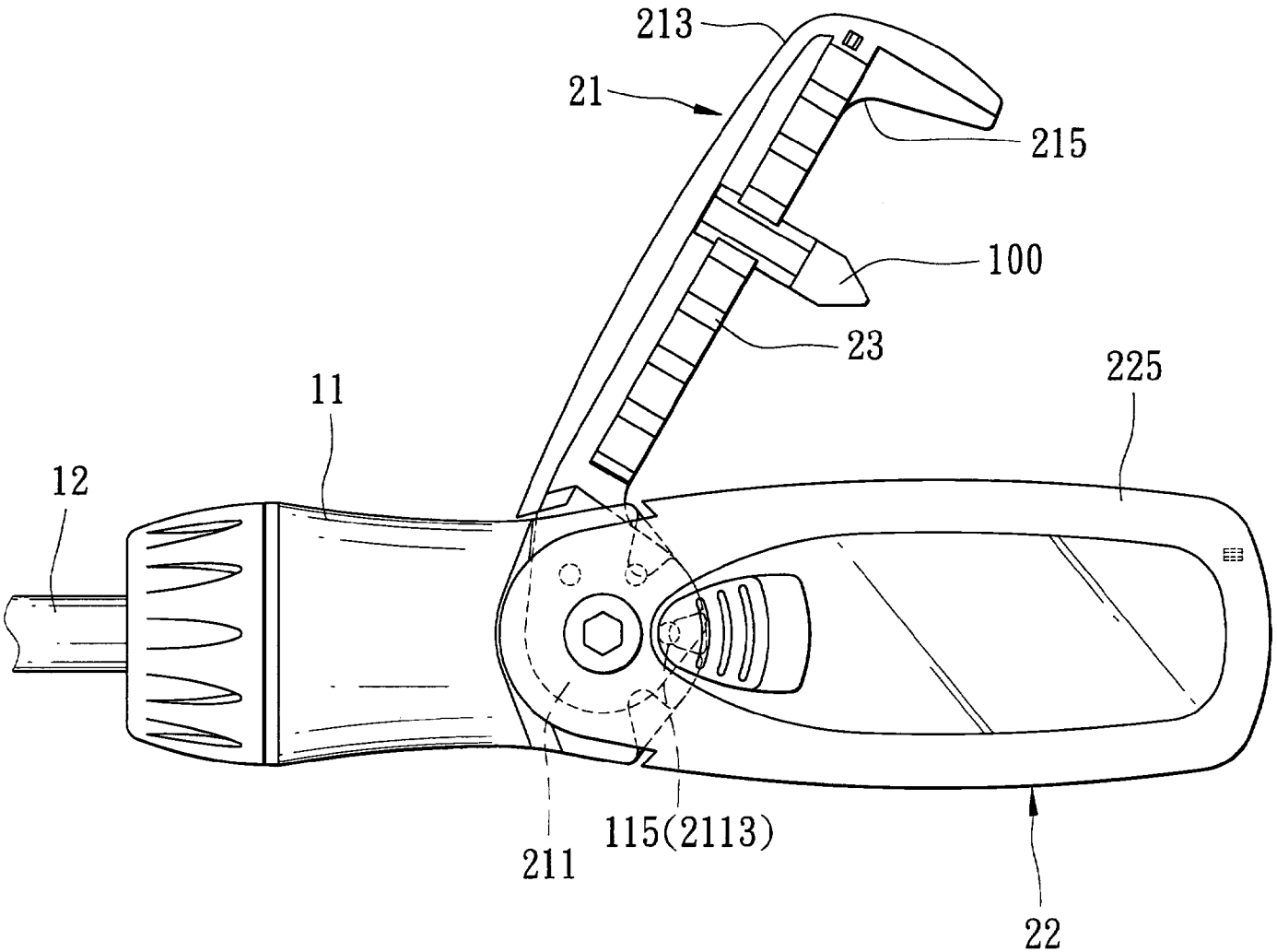
Figure 10:
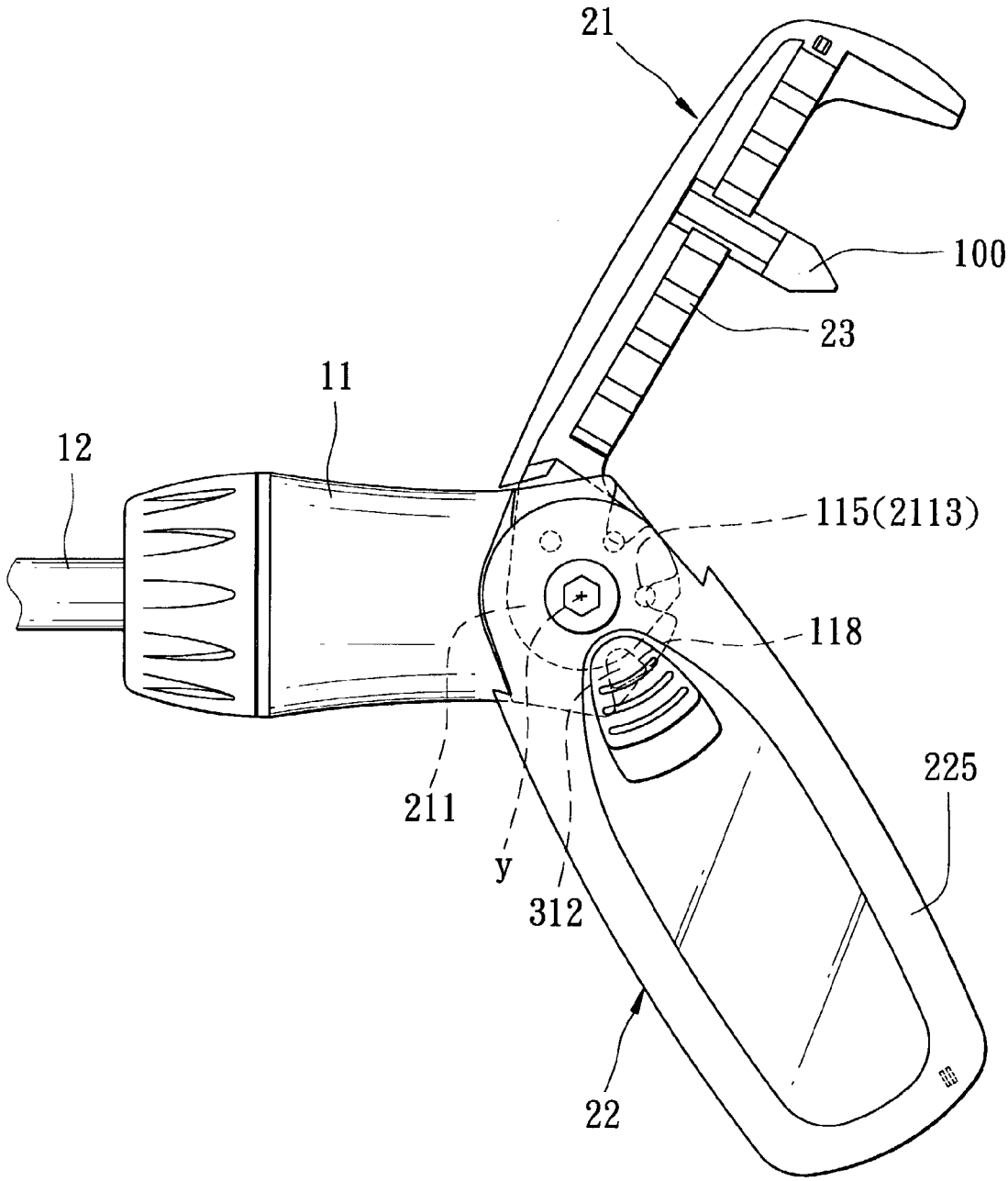

On the other hand, when the cover portion 213 is lifted so as to turn the second front end 211 to the open position, as shown in FIGS. 9 and 10, the inner surface 215 of the cover portion 213 is exposed, thereby providing access to the replacement bit receiving space 40. Thus, a desired one of the replacement tool bits 100 can be removed from the replacement bit positioning member 23 to replace the tool bit 100 (not shown) on the tool shaft 12.

Figure 7:
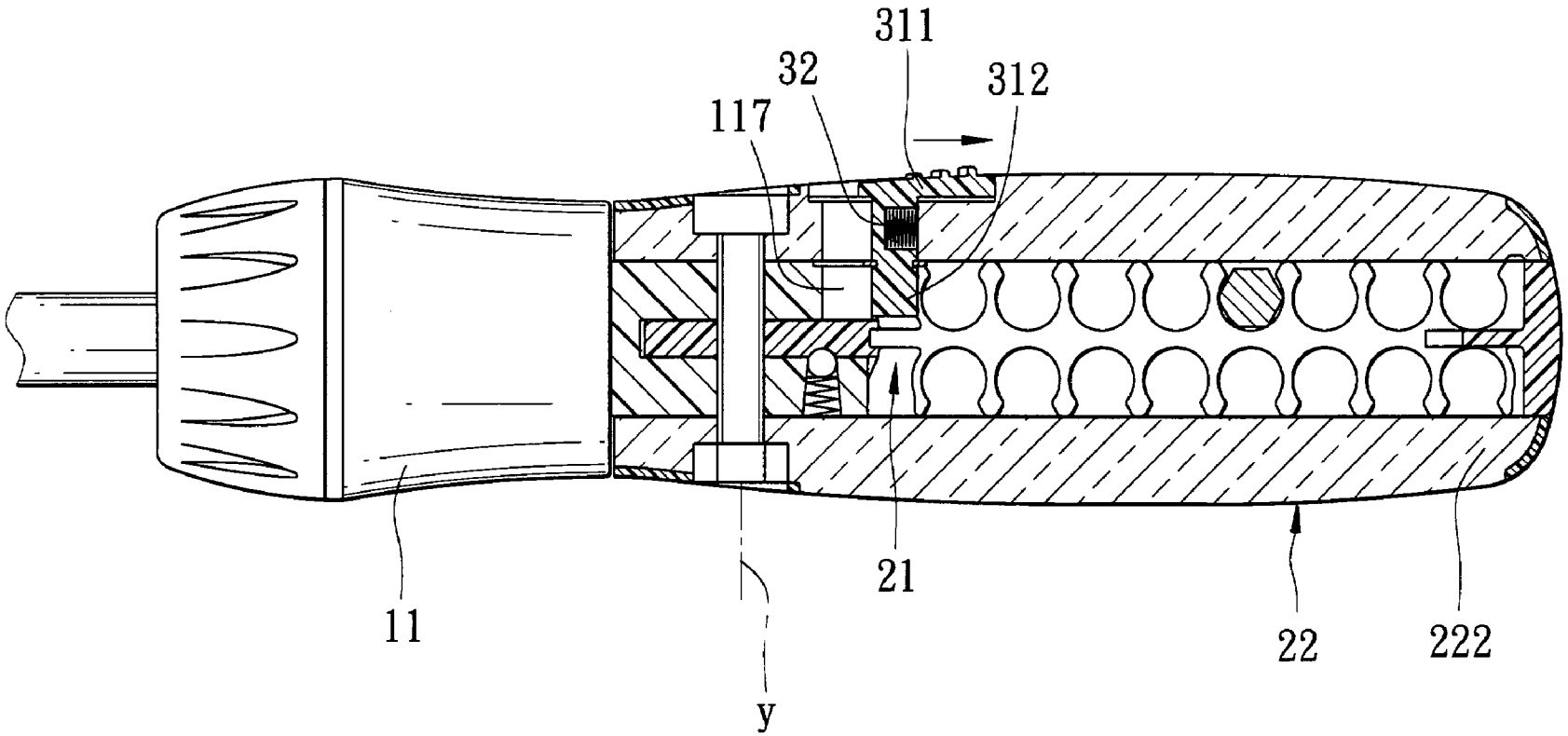
FIG. 7 is a partly sectional view similar to FIG. 4, showing that a retaining member is moved rearwards.

The retaining member 30 is received in the opening 2252, and includes a retaining protrusion 312 which is mounted in the left wall 225 and which extends into the access 41, an operation stem 313 which extends from the retaining protrusion 312 and which is movably received in the smaller-dimension portion 2254, and an operation portion 311 which is received in the larger-dimension portion 2253 and which is exposed outwardly of the left wall 225, a snap ring 33 which is sleeved on a juncture between the retaining protrusion 312 and the operation stem 313 and which abuts against an inner wall surface 227 of the left wall 225, and a biasing unit 32, such as a spring 32, which is disposed in the smaller-dimension portion 2254 to bias the operation stem 313 forwards. As such, the operation portion 311 is operable manually to move the retaining protrusion 312 in a direction parallel to the axis (x2) from an engaging position, as shown in FIG. 4, where the retaining protrusion 312 engages one of the retaining recesses 116,117,118 so as to arrest the coupling end portion 112 in a respective one of the normal and torque enhancing positions, to a disengaging position against biasing force of the biasing unit 32, as shown in FIG. 7, where the retaining protrusion 312 disengages from said one of the retaining recesses 116,117,118 so as to permit turning of the coupling end portion 112 about the pivot axis (y). In this embodiment, when the rear handle body 22 is in the normal position, the retaining protrusion 312 engages the retaining recess 117, as shown in FIGS. 3 and 4.

Figure 8:
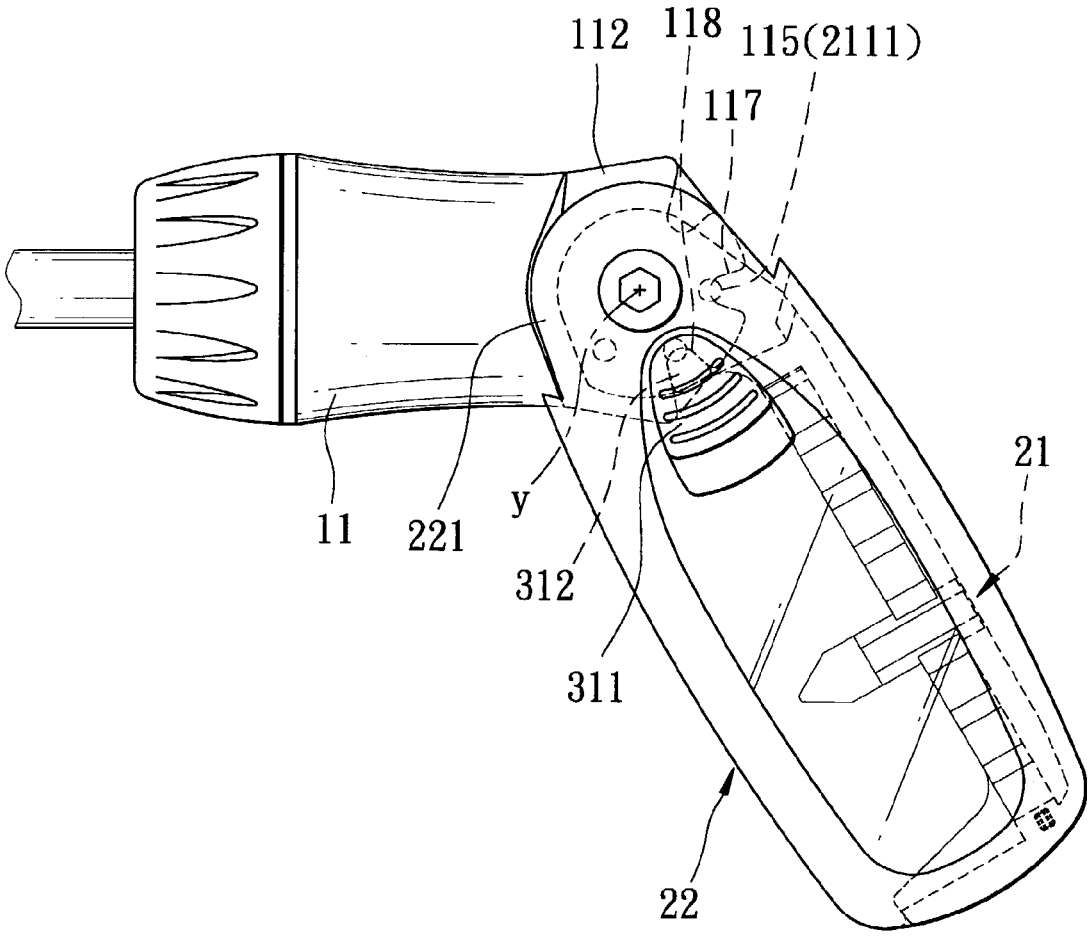
FIGS. 8, 9 and 10 are schematic views illustrating three different operating modes of the swingable handle.

In use, as illustrated in FIGS. 7 and 8, the operation portion 311 is moved manually to permit disengagement of the retaining protrusion 312 from the retaining recess 117. In this state, the coupling end portion 112 is turnable relative to the first front ends 221 about the pivot axis (y) until the retaining protrusion 312 engages the adjacent retaining recess 118 through the biasing force of the biasing unit 32. Thus, the rear handle body 22 is placed in the torque enhancing position.

Figure 3:
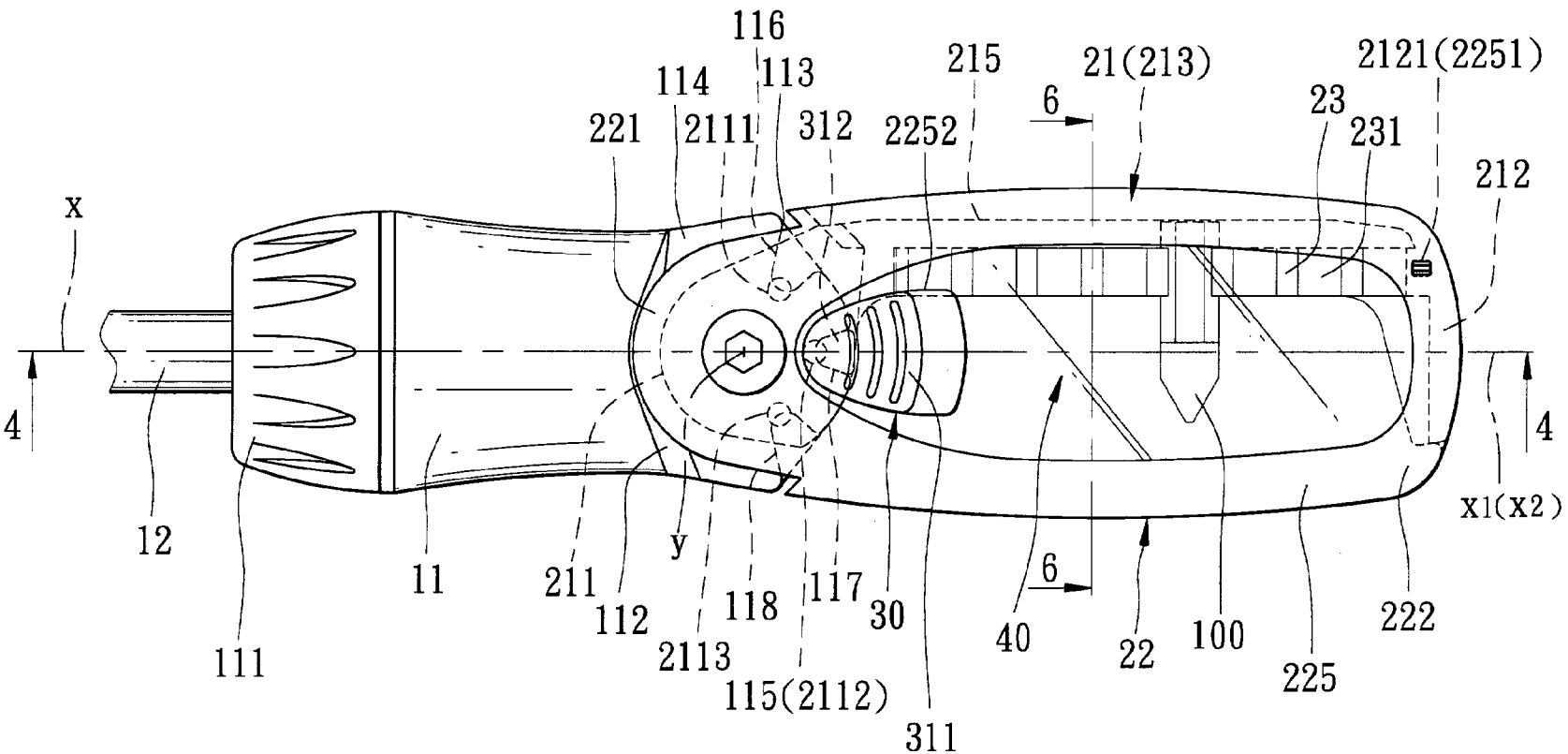
FIG. 3 is a side view of the preferred embodiment.
Figure 4:
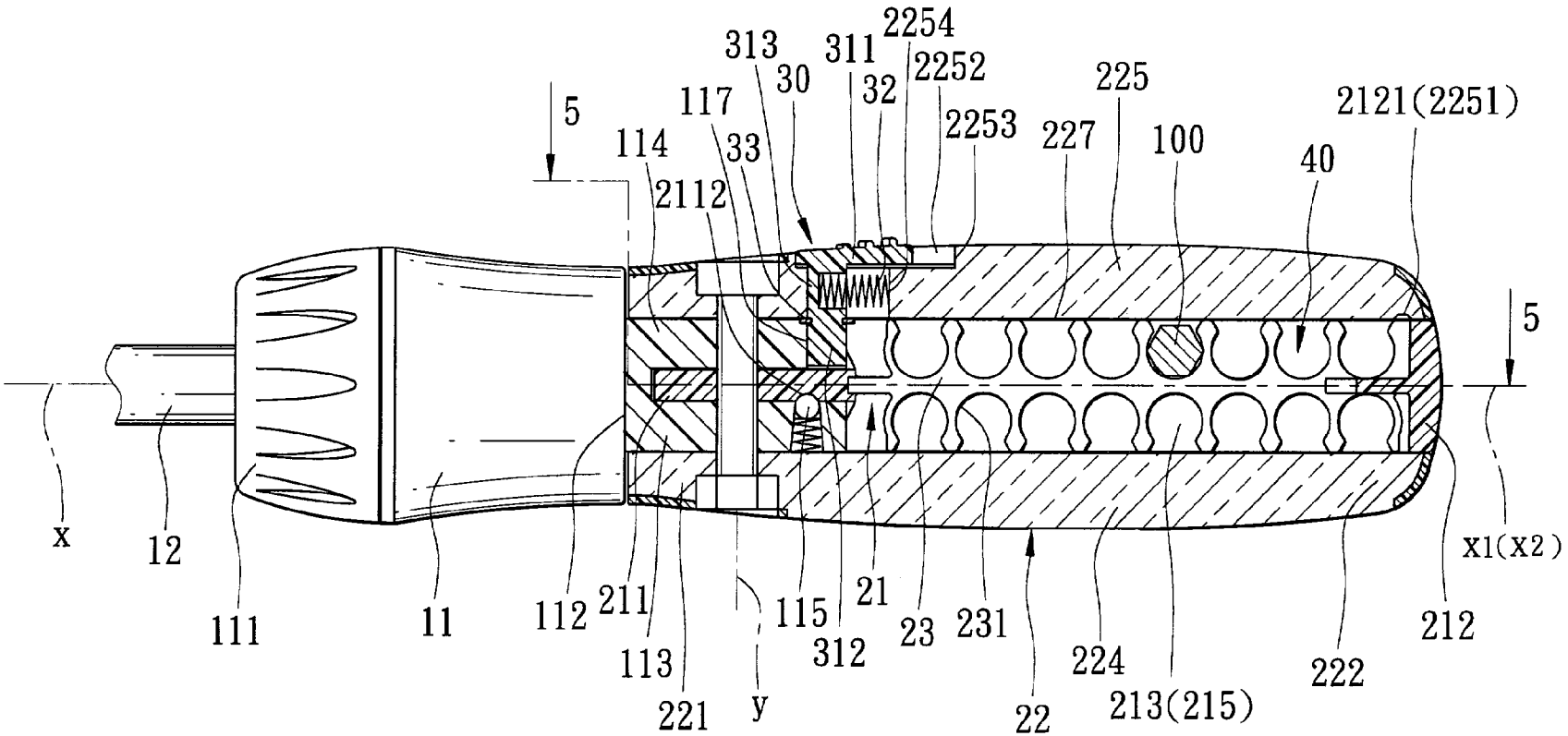
FIG. 4 is a partly sectional view of the swingable handle shown in FIG. 3, taken along lines 4—4 thereof.
Figure 5:
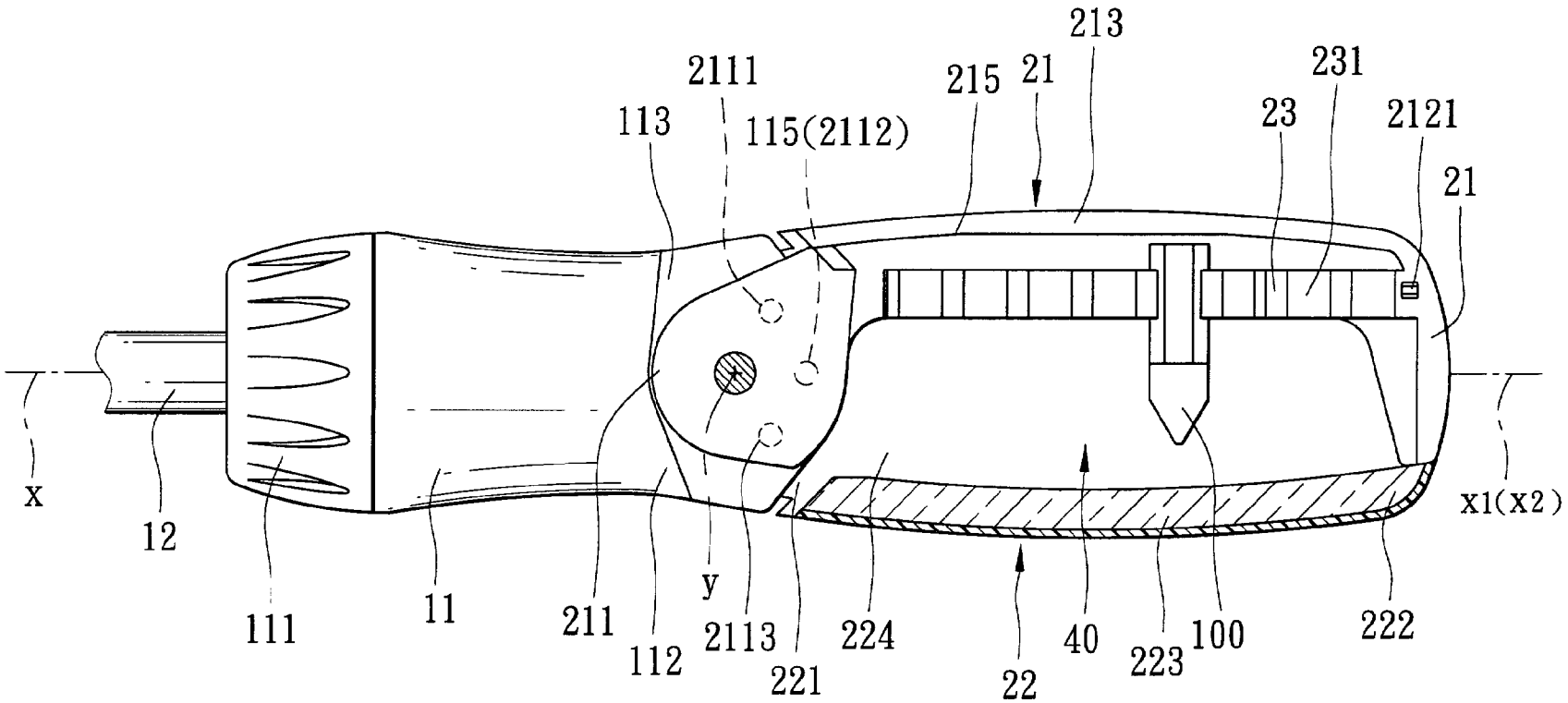
FIG. 5 is a partly sectional view of the swingable handle shown in FIG. 3, taken along lines 5—5 thereof.
Figure 6:
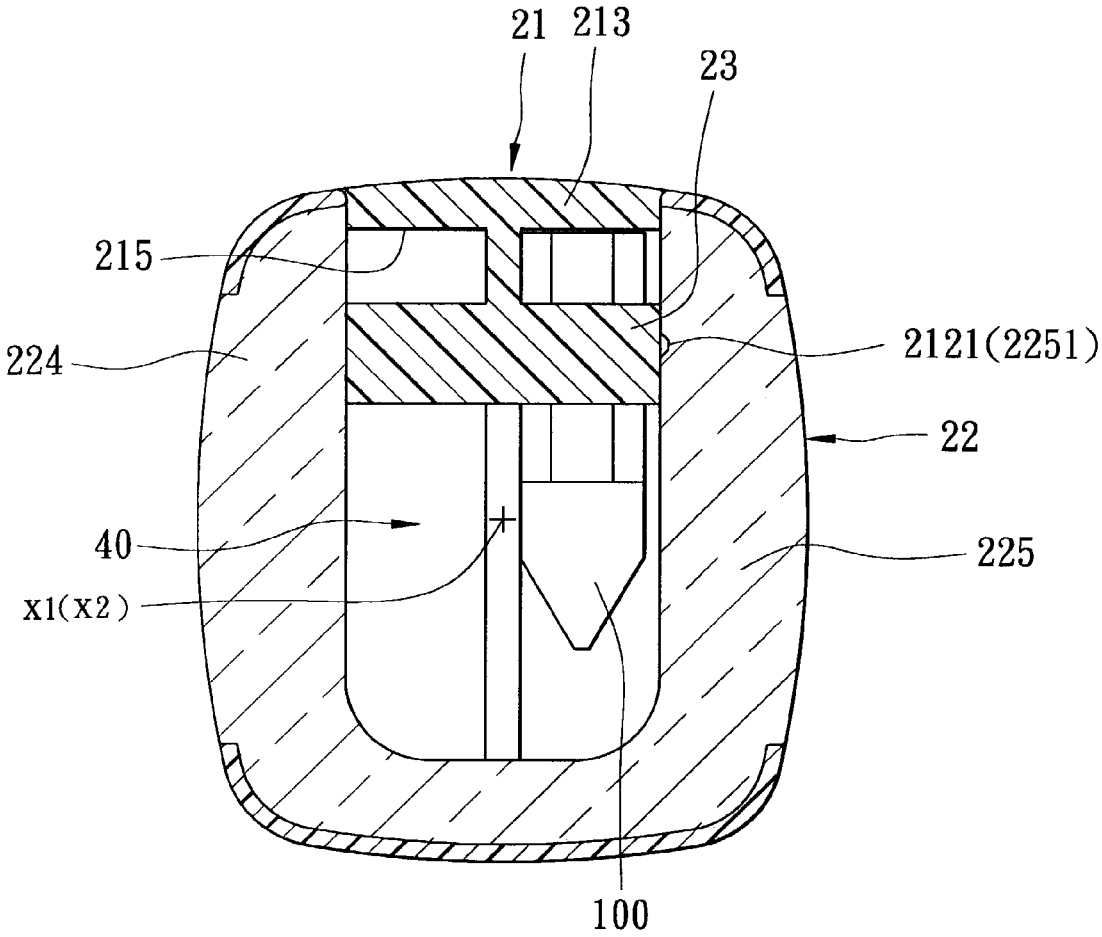
FIG. 6 is a partly sectional view of the swingable handle shown in FIG. 3, taken along lines 6—6 thereof.

When it is desired to replace the tool bit 100 on the tool shaft 12, the second front end 211 of the lid member 21 is forced to turn about the pivot axis (y) from the closed position, as shown in FIG. 3, to the open position, as shown in FIG. 9, where the spring-loaded ball 115 slips into the recess 2113, and where the lid member 21 forms an included angle of about 60° with the rear handle body 22. Thus, a desired tool bit 100 can be removed from the replacement bit positioning member 23. Alternatively, as shown in FIG. 10, when the rear handle body 22 is placed in the torque enhancing position where the retaining protrusion 312 engages the retaining recess 118, the second front end 211 of the lid member 21 forms a larger included angle of about 120° with the rear handle body 22 so as to facilitate removal of a tool bit 100 received in the replacement bit receiving space 40 close to the pivot axis (y).

In sum, by turning the rear handle body 21 relative to the front handle body 11 from the normal position to the torque enhancing position, the swingable handle of this invention can be used to rotate a tool bit 100 with less effort. In addition, due to the provision of the replacement bit positioning member 23, the replacement tool bits 100 can be positioned orderly in the replacement bit receiving space 40, thereby facilitating selection of the tool bits 100. Furthermore, since the included angle between the lid member 21 and the rear handle body 22 can be varied, removal of the tool bit 100 from the replacement bit positioning member 23 is convenient, especially those disposed close to the pivot axis (y).

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A swingable handle for delivering torque to rotate a tool shaft together with a tool bit about a rotating axis and for receiving a plurality of replacement tool bits therein, said handle comprising:

a rear handle body having an outer wall which defines a replacement bit receiving space therein, and which has a first front end that defines an access to said replacement bit receiving space;

a front handle body having a mount end portion adapted to connect with the tool shaft, and a coupling end portion opposite to said mount end portion along the rotating axis, said coupling end portion being pivoted to and turnable relative to said first front end of said outer wall about a pivot axis in a transverse direction transverse to the rotating axis between a normal position, where said front and rear handle bodies are in line with each other, and a torque enhancing position, where said rear handle body is inclined relative to the rotating axis;

a lid member having a second front end which is pivoted to and which is turnable relative to said first front end of said outer wall about the pivot axis between open and closed positions, and a cover portion which extends from said second front end radially relative to the pivot axis and which has an inner surface that confronts said replacement bit receiving space, such that when said second front end is in the closed position, said cover portion covers said replacement bit receiving space, and such that when said second front end is in the open position, said inner surface of said cover portion is exposed, thereby providing access to said replacement bit receiving space; and a replacement bit positioning member disposed on one of said inner surface and said outer wall for positioning the replacement tool bits.

2. The swingable handle of claim 1, wherein said outer wall of said rear handle body includes right and left walls which are spaced apart from each other in the transverse direction to confine said replacement bit receiving space therebetween, and an inner bottom wall which extends in the transverse direction to interconnect said right and left walls, and which confronts said replacement bit receiving space, said right and left walls having front ends which are spaced apart from each other in the transverse direction so as to serve as said first front end.

3. The swingable handle of claim 2, wherein said replacement bit positioning member includes a plurality of grip units which are integrally formed with one of said inner surface and said inner bottom wall and which are disposed in tandem in a radial direction relative to the pivot axis.

4. The swingable handle of claim 2, wherein said coupling end portion includes right and left coupling walls which are spaced apart from each other in the transverse direction, and which are received in said access to confront said front ends of said right and left walls, respectively, along the pivot axis, said second front end being interposed between said right and left coupling walls, and having right and left side surfaces which confront said right and left coupling walls, respectively, along the pivot axis such that said front ends of said right and left walls, said right and left coupling walls and said second front end are pivoted coaxially about the pivot axis.

5. The swingable handle of claim 4, further comprising a slidably retaining member disposed between said right coupling wall and said right side surface so as to slidably retain said second front end in one of the open and closed positions.

6. The swingable handle of claim 5, wherein said slidably retaining member includes a plurality of recesses formed in said right side surface and angularly displaced from each other about the pivot axis, and a spring-loaded ball retractably disposed in said right coupling wall and depressable to slip into a selected one of said recesses so as to place said second front end in a corresponding one of the open and closed positions.

7. The swingable handle of claim 5, further comprising a retaining member disposed to arrest said coupling end portion in one of the normal and torque enhancing positions.

8. The swingable handle of claim 7, wherein said left coupling wall has a retaining wall surface which faces rearward and which includes a plurality of retaining recesses formed therein and angularly displaced from one another about the pivot axis, said retaining member including a retaining protrusion which is mounted in said left wall, which extends into said access, and which is movable relative to said left wall in a radial direction relative to the pivot axis between an engaging position, where said retaining protrusion engages one of said retaining recesses so as to arrest said coupling end portion in a respective one of the normal and torque enhancing positions, and a disengaging position, where said retaining protrusion disengages from said one of said retaining recesses so as to permit turning of said coupling end portion about the pivot axis, a biasing unit which is disposed to bias said retaining protrusion towards the engaging position, and an operation stem which extends from said retaining protrusion outwardly of said left wall so as to be operable manually to move said retaining protrusion toward the disengaging position against biasing force of said biasing unit.

9. The swingable handle of claim 2, wherein said right and left walls have rear ends opposite to said first front ends, respectively, such that said cover portion covers said rear ends when said second front end is in the closed position, said rear ends being configured to be in a press-fit engagement with said cover portion when said cover portion covers said rear ends.

* * * * *